US006652714B1

(12) United States Patent
Breaux

(10) Patent No.: US 6,652,714 B1
(45) Date of Patent: Nov. 25, 2003

(54) DRILL STEM STABILIZER

(75) Inventor: Braddie D. Breaux, Sulphur, LA (US)

(73) Assignee: Foster Wheeler Corporation, Clinton, NJ (US)

( * ) Notice: Subject to any disclaimer, the term of this patent is extended or adjusted under 35 U.S.C. 154(b) by 0 days.

(21) Appl. No.: 09/453,710

(22) Filed: Dec. 3, 1999

Related U.S. Application Data

(60) Provisional application No. 60/134,217, filed on May 14, 1999.

(51) Int. Cl.[7] ..... C10B 57/00; B01J 8/02

(52) U.S. Cl. ..... 202/241; 568/700; 422/211; 422/191; 422/311; 422/171; 408/705; 432/2; 208/131; 134/39; 134/167 R

(58) Field of Search ..... 568/700; 502/11, 502/400; 422/211, 191, 311, 171; 408/705; 432/2; 208/131; 134/39, 167 R; 201/2

(56) References Cited

U.S. PATENT DOCUMENTS

| | | | | |
|---|---|---|---|---|
| 2,245,554 | A | 6/1941 | Court | 141/1 |
| 3,314,671 | A | 4/1967 | Heino et al. | 266/42 |
| 4,165,261 | A | 8/1979 | Henstra et al. | 202/241 |
| 4,375,389 | A | 3/1983 | Lindgren | 202/241 |
| 4,611,613 | A | 9/1986 | Kaplan | 134/95 |
| 4,626,320 | A | 12/1986 | Alworth et al. | 201/2 |
| 5,013,408 | A | 5/1991 | Asai et al. | 202/241 |
| 5,022,799 | A | 6/1991 | Torres et al. | 408/1 R |
| 5,034,104 | A | 7/1991 | Gregor et al. | 202/241 |
| 5,092,963 | A | 3/1992 | Barker et al. | 202/250 |
| 5,259,930 | A | 11/1993 | Barker et al. | 201/2 |
| 5,417,811 | A | 5/1995 | Malsbury | 202/241 |
| 5,579,787 | A | 12/1996 | Wood | 134/22.1 |
| 5,794,729 | A | 8/1998 | Van Meter et al. | 175/424 |
| 5,846,034 | A | 12/1998 | Martin et al. | 408/1 R |
| 5,855,742 | A | 1/1999 | Lumbroso et al. | 202/241 |

*Primary Examiner*—Glenn Caldarola
*Assistant Examiner*—Alexis Wachtel
(74) *Attorney, Agent, or Firm*—Fitzpatrick, Cella, Harper & Scinto

(57) ABSTRACT

A drill stem stabilizer used in a decoking apparatus that includes a drill stem and a drilling structure on which the drill stem is supported for vertical movement above and within a coke drum. The stabilizer includes a bearing and a support member. The bearing is adapted to guide the longitudinal movement of the drill stem. The support member extends laterally from the bearing and attaches to the drilling structure, and maintains the bearing in a position to guide the drill stem as it is moved into or out of the coke drum. In one embodiment, the drilling structure includes a pair of substantially vertical guide rails, and the support member attaches to the guide rails.

27 Claims, 7 Drawing Sheets

DRILL STEM STABILIZER

This application claims the benefit of U.S. Provisional Application No. 60/134,217, filed May 14, 1999.

BACKGROUND OF THE INVENTION

1. Field of the Invention

The present invention generally relates to decoking or drilling coke from a coking drum. In particular, this invention relates to stabilizing the stem of a decoking drill.

2. Background Art

Coking apparatuses and decoking techniques are well known in the refining industry. Therefore, these apparatuses and techniques will be described only as necessary to appreciate the environment of my invention. Coal or hydrocarbon material is typically refined in large coke drums. These coke drums are often several stories high. Coke, a residue produced during the refining process, builds up within these drums and must be periodically removed.

Coke is removed from a drum in a process commonly known as decoking, cutting, or drilling. In a cutting process, a coke cutter or "drill" uses jets of pressurized water to break up coke residue caked on the inside of the coke drum. One example of a basic drilling apparatus and coke drum is shown in U.S. Pat. No. 2,245,554 (the '544 patent), incorporated herein by reference.

The basic decoking or drilling apparatus will be described briefly with reference to FIG. 1. The actual cutting tool or drill bit (not shown in FIG. 1) is located at the lower terminus of a drill stem (e.g., piping) 10. Pressurized water is supplied through the drill stem 10 to the cutting tool. The drill stem 10 depends from a turntable (or like rotatable mechanism and motor) 12, which is supported by a crosshead 11. The cutting tool, drill stem 10, turntable 12 and crosshead 11 are all part of a drill assembly. The drill assembly is supported by a scaffolding or superstructure 17. A pair of vertical guide rails 14*a* and 14*b*, such as I-beam channels, are provided on the superstructure 17. During the cutting process, the crosshead 11 rides vertically on the guide rails 14*a* and 14*b* (via roller bearings or the like) to adjust the height of the drill stem 10 and cutting tool in and above a coke drum 20. A pair of mechanical stops 13*a* and 13*b* on the guide rails 14*a* and 14*b* prevents the crosshead 11 from descending vertically below a stop position. The stop position is selected to prevent the crosshead 11 from descending too low or entirely off the guide rails 14*a* and 14*b*, while permitting the cutting tool at the end of the drill stem 10 to reach the desired depth in the coke drum 20.

To initiate the cutting process, a top head 19 of the drum 20 is unlatched, and a stem guide (not shown) is secured to the resulting top opening of the drum 20. The stem guide, one example of which is illustrated in U.S. Pat. No. 5,092,463 (the '463 patent), incorporated herein by reference, keeps the drill stem 10 from being thrown off-center during cutting or drilling. The stem guide shown in the '463 patent has dual clamping parts, which when open permit the cutting tool to pass through and into the coke drum 20, and when closed closely surround the drill stem 10. After the stem guide has been positioned on the top drum opening, the stem guide is opened and the drill stem 10 and cutting tool are lowered into the coke drum 20.

Due to the length of the drill stem 10 and the weight of the cutting tool in the drill assembly shown in FIG. 1, the drill stem/cutting tool combination can behave like a pendulum. As it is lowered into the coke drum 20, the cutting tool will tend to swing back and forth at the end of the drill stem 10 in relation to the top drum opening. This problem is exacerbated in high winds.

Even in calm conditions, two operators are typically required to position the cutting tool within the drum 20 according to the above-described configuration. A first operator controls a winch, which lowers and raises the crosshead 11, along with the cutting tool and drill stem 10. A second operator manually guides the cutting tool and drill stem 10 through the stem guide opening into the coke drum 20. The second operator risks exposure to hazardous steam vapors, including high concentrations of hydrochloric sulfuric acid ($H_2S$), by standing over the drum opening while guiding the cutting tool and drill stem 10 into the drum 20. The swinging cutting tool also poses a risk to the second operator, especially during windy conditions.

These problems are not adequately addressed in the art. For example, the '544 patent only envisions a dual-plate stem guide, attaching to the top of the drum head. Like the stem guides discussed above, this dual plate configuration guides a drill stem during the cutting process. Yet, the '544 patent does not contemplate guiding and stabilizing the drill stem during its descent into the coke drum, or stabilizing the drill stem as it is raised after the decoking process is complete.

Thus, there is a need in the art for a mechanism to restrict the pendulum effect of the cutting tool and drill stem 10. There is another need for a mechanism that obviates the need for an operator to stand over the top drum opening during insertion or withdrawal of the cutting tool. There is a further need for such a mechanism that does not interfere with the attachment or removal of the stem guide.

SUMMARY OF THE INVENTION

The present invention relates to a drill stem stabilizer that guides the movement of a drill stem as the stem is raised and lowered relative to a coke drum opening.

According to one aspect of the invention, a stabilizer is provided in a decoking apparatus that is for use with a coking drum having a top opening. The decoking apparatus includes a drill stem, a crosshead from which the drill stem depends, and a pair of substantially vertical guide rails on which the crosshead rides. The stabilizer includes a bearing encasing the drill stem so as to limit lateral movement of the drill stem. The stabilizer also includes a support member extending laterally from the bearing and attached to each of the pair of the guide rails. The support member maintains the bearing in a position to align the drill stem with the top opening of the drum.

According to another aspect of the invention, a coke drilling apparatus is provided for use with a coking drum having a top opening. The coke drilling apparatus includes a drill stem, a crosshead from which the drill stem depends, a pair of substantially vertical guide rails on which the crosshead rides, and a drill stem stabilizer. The drill stem stabilizer attaches to each of the pair of guide rails and defines an opening through which the drill stem extends. The opening is positioned to align the drill stem with the top opening of the drum.

According to yet another aspect of the invention, a stabilizer is used in a decoking apparatus that is for use with a coke drum. The decoking apparatus includes a drill stem and a structure on which the drill stem is supported for vertical movement above and within the coke drum. The stabilizer includes a bearing and a support member. The bearing encases the drill stem so as to limit lateral movement of the drill stem. The support member extends laterally from the bearing and attaches to the structure. The support member maintains the bearing in a position so as to guide the drill stem into and out of the coke drum.

Another aspect of the invention relates to a stabilizer in a decoking apparatus that is for use with a coking drum having a top opening. The decoking apparatus includes a drill stem, a crosshead from which the drill stem depends, and a pair of substantially vertical I-beam guide rails defining channels in which the crosshead rides. The stabilizer includes a bearing made up of a complementary pair of half-cylindrical rings. Each half-cylindrical ring includes a pair of mating longitudinal faces and a flange extending from near each of the pair of longitudinal faces. The two rings are attached to one another via the flanges so as to form a cylindrical ring. The cylindrical ring encases the drill stem so as to limit lateral movement of the drill stem. The stabilizer also includes a support member having two I-beam segments extending laterally from the bearing. Each I-beam segment has an attaching end and a receiving end. The attaching end nests within and attaches to the channel of a respective one of the pair of the I-beam guide rails. The receiving end attaches to the bearing. The support member maintains the bearing in a position so as to align the drill stem with the top opening of the drum.

These and other objects, features and advantages will be apparent from the following description of the preferred embodiments of the present invention.

BRIEF DESCRIPTION OF THE DRAWINGS

The present invention will be more readily understood with reference to the following drawings, in which like reference numbers refer to like elements throughout.

DETAILED DESCRIPTION OF THE PREFERRED EMBODIMENTS

Figure 1:
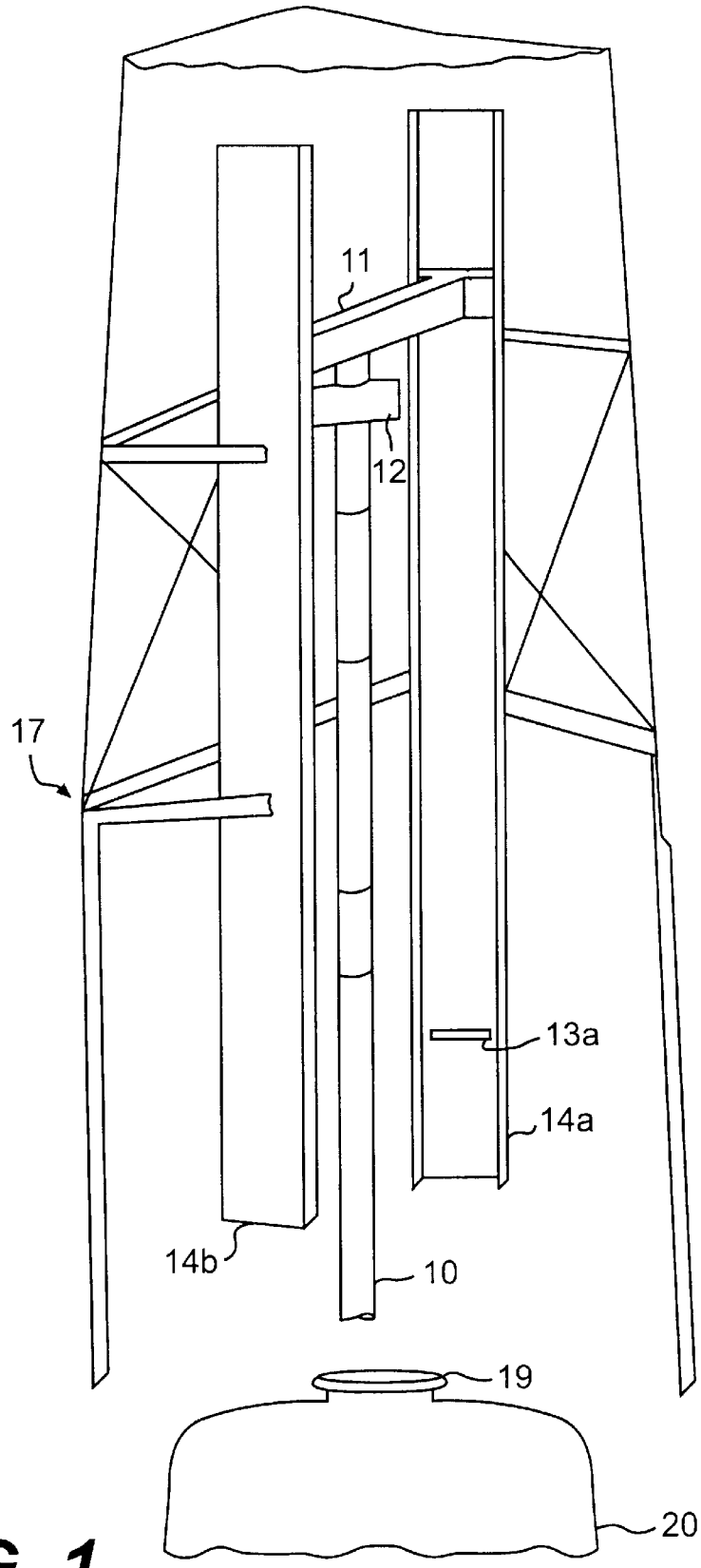
FIG. 1 shows a partial perspective view of a conventional decoking apparatus and a coke drum.

To remedy the problems associated with the prior art, which have been discussed above, a drill stem stabilizer 1 is provided for use with a decoking apparatus, such as the conventional apparatus illustrated in FIG. 1.

Figure 2:
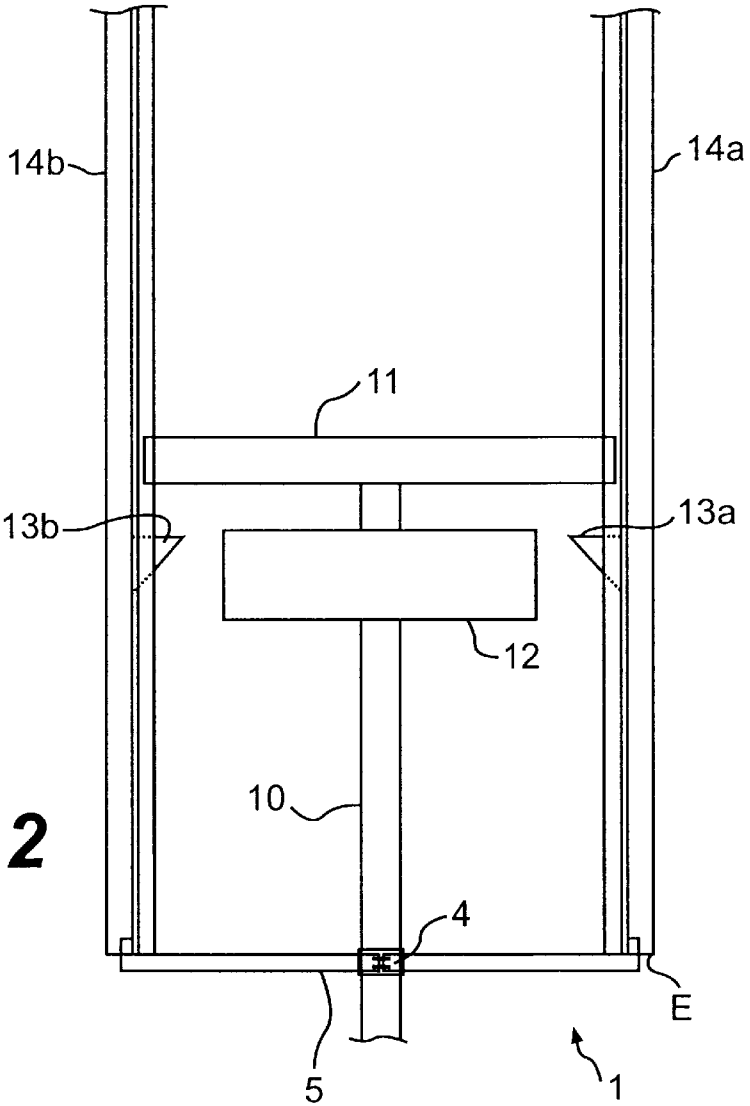
FIG. 2 shows a detailed schematic view of the decoking apparatus of FIG. 1, employing a drill stem stabilizer according to an embodiment of the present invention.

As shown in FIG. 2, the drill stem stabilizer 1 generally includes a bearing 4 and a support member 5. The bearing 4 restricts the lateral motion of the drill stem 10, while allowing the stem 10 to move longitudinally and rotate on its axis. The support member 5 maintains the bearing 4 in its proper position, as described below. With this configuration, the bearing 4 guides the drill stem 10 as it moves longitudinally (vertically) toward or away from the drum 20 (shown, for example, in FIG. 1).

The support member 5 supports the bearing 4 and attaches to the superstructure 17, preferably to the guide rails 14*a* and 14*b*, shown in FIG. 1. The support member 5 maintains the bearing 4 in a position so as to align the cutting tool and drill stem 10 with the top opening of the drum 20 as the cutting tool is lowered into or raised out of the top of the drum 20. The drill stem stabilizer 1 is positioned so as not to interfere with the movement of the drill assembly, while still effectively stabilizing the drill stem 10.

Figure 3:
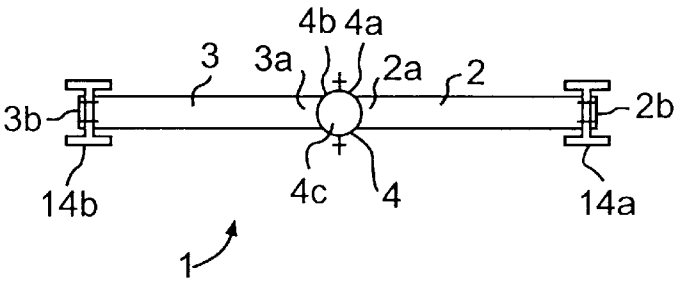
FIG. 3 shows a top view of the drill stem stabilizer shown in FIG. 2.
Figure 4:
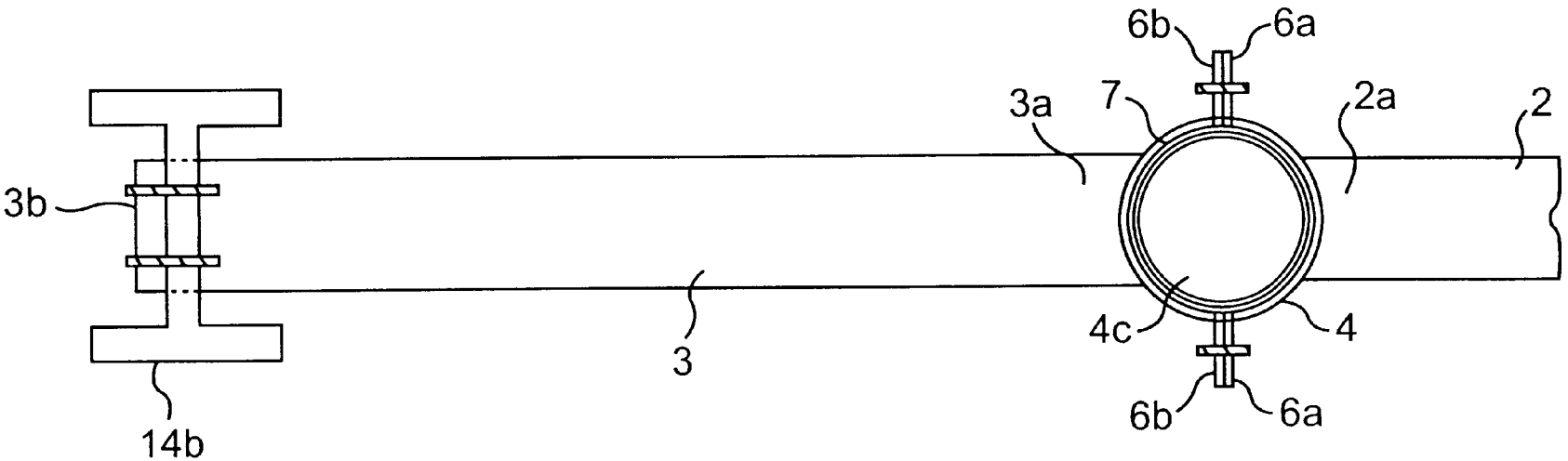
FIG. 4 is an enlarged top partial view of the drill stem stabilizer shown in FIG. 2.
Figure 5:
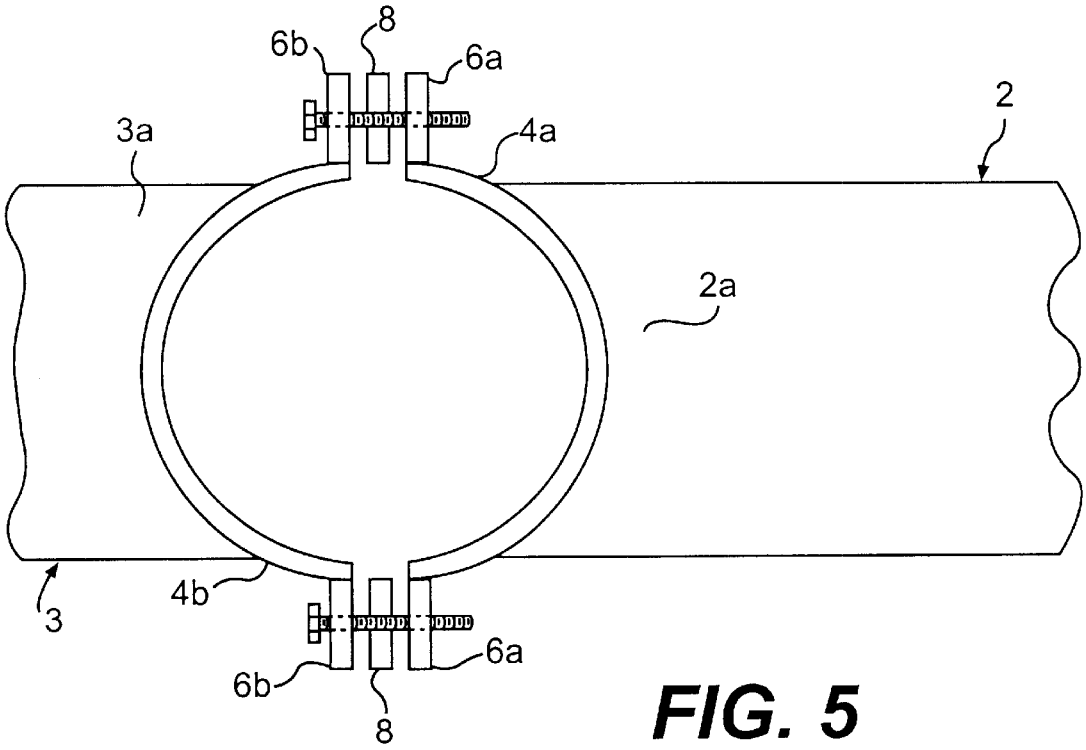
FIG. 5 is an exploded partial top view of the drill stem stabilizer shown in FIG. 2.

A preferred embodiment of the drill stem stabilizer 1 of the invention is illustrated in more detail in FIGS. 3, 4, and 5. The bearing 4 preferably defines an opening 4*c* through which the drill stem 10 passes. In this embodiment, the bearing 4 is generally cylindrical, formed by a pair of split ring (e.g., half-cylindrical) pieces 4*a* and 4*b*. The split ring pieces 4*a* and 4*b* can be formed by a pipe segment that has been cut in half longitudinally. The surfaces formed by the cutting of the pipe (i.e., the mating longitudinal faces) are then rejoined around the drill stem 10, and the split ring pieces 4*a* and 4*b* are secured together to form the cylindrical bearing 4. When secured or attached together, the split ring pieces 4*a* and 4*b* define an opening 4*c*, which encases the drill stem 10.

In the illustrated embodiment, the split ring pieces 4*a* and 4*b* are secured to one another via pairs of flanges 6*a* and 6*b* that extend radially out from the split rings 4*a* and 4*b* (see FIG. 4). The pair of flanges 6*a* and 6*b* can be integrally formed with the split ring pieces 4*a* and 4*b*, or can be attached (e.g., welded, bolted, or otherwise secured) to the split rings 4*a* and 4*b*, respectively. The flanges 6*a* and 6*b* extend from near each edge of the cut or exposed mating longitudinal faces of the split ring pieces 4*a* and 4*b*, as seen in FIG. 5.

In one embodiment, bolts are used to fasten the two split rings 4*a* and 4*b* together to surround or encase the drill stem 10. Specifically, bolts can be secured through mating holes formed in each of the flanges 6*a* and 6*b*. Alternatively, the two split ring pieces 4*a* and 4*b* can be welded, or a latch, band or other clamping device can be employed to secure the split ring pieces 4*a* and 4*b* around the drill stem 10. Also, the split ring pieces 4*a* and 4*b* can be hinged together, with a clamp opposite to the hinge.

As an alternative embodiment, an uncut bearing 4 or other single-piece structure that bounds or encloses an opening can be used with the drill stem stabilizer 1, instead of using two split ring pieces 4*a* and 4*b*. In such an embodiment, the bearing 4 could be "threaded", rather than clamped, onto the drill stem 10. As another alternative embodiment, the bearing can partially encase the drill stem 10. Of course, the bearing should encase enough of the drill stem 10 so as to restrict lateral movement of the drill stem 10 as the cutting tool is lowered or raised with respect to the drum 20. For example, the partial enclosing bearing could surround 270 degrees or so of the drill stem.

The surface of the bearing 4 that engages the drill stem 10 preferably is lined with a lining or bushing 7. The bushing 7 reduces friction between the bearing 4 and the drill stem 10. Any suitable friction reducing material, such as TEFLON®, can be used for the bushing 7. The bushing 7 can be secured to the bearing 4 by bolts or screws (or other similar attaching means), which can be countersunk to prevent contact by the bolts or screws with the drill stem 10. If split ring pieces 4*a* and 4*b* are used to form the bearing 4, the bushing 7 can likewise be formed of separate pieces attached to the pieces 4*a* and 4*b*, individually. Alternatively, instead of using a bushing 7, the inner surface of the bearing 4 could be grooved to accommodate an O-ring, or the like, and coated by a lubricant (e.g., grease). This configuration would also reduce friction.

The clearance between the bearing 4 (or bushing 7) and the drill stem 10 should be chosen so as not to interfere with the longitudinal or rotational movement of the drill stem 10, while still providing adequate stability for the drill stem 10 as it is lowered into the top opening of the drum 20. If the clearance is too small, the bearing 4 and drill stem 10 can bind, interfering with the lowering of the cutting tool or creating drag on the motor of the turntable 12 or the crosshead winch. Only a small amount of a position to guide the drill stem into and out of the coke drum. clearance (e.g., about ¼ inch) between the bearing 4 (or lining 7, if used) and the drill stem 10 is needed to prevent unnecessary drag on the drill stem 10. This clearance can be increased as long as the drill stem is still properly guided into the drum opening 19. If the clearance becomes too great, so does the range of motion of the cutting tool in the pendulum action discussed above. If necessary in order to ensure that the splitting-ring-type bearing 4 will have a sufficient diameter to fit around or otherwise enclose the drill stem 10 with the proper clearance, a spacer 8 can be placed between the flanges 6*a* and 6*b*.

In the preferred embodiment, the support member 5 includes two bars or segments 2 and 3. The respective lengths of the segments 2 and 3 can be selected to properly position the bearing 4 when secured to the crosshead guide rails 14*a* and 14*b* (or other suitable location on the superstructure 17). The beam segments 2 and 3 each has a receiving end (2*a* and 3*a*, respectively) for attachment to the bearing 4 and an attaching end (2*b* and 3*b*, respectively) for attachment to the superstructure 17.

If the crosshead guide rails 14*a* and 14*b* are I-beam channels, the segments 2 and 3 can be I-beam segments, with a smaller width than the guide-rail I-beams 14*a* and 14*b*, so that the attaching ends 2*b* and 3*b* of the segments 2 and 3 will nest within the I-beams 14*a* and 14*b*. The segments 2 and 3 may alternately be formed of pipes, rods or any other suitable structure, as long as the position of the bearing 4 is rigidly maintained thereby.

In the illustrated embodiment, the split ring pieces 4*a* and 4*b* of the bearing 4 are attached or otherwise secured to the receiving ends 2*a* and 3*a*, respectively, of the segments 2 and 3. The receiving ends 2*a* and 3*a* of the segments 2 and 3 may be milled, shaped or cut in an inward concave manner to facilitate receiving the split ring pieces 4*a* or 4*b*. The split rings 4*a* and 4*b* are preferably welded to the receiving ends 2*a* and 3*a*, respectively. Alternatively, the split rings 4*a* and 4*b* may be bolted, clamped, slot-fitted, or otherwise secured to the segments 2 and 3.

If a solid or non-cylindrical bearing is used, segments 2 and 3 can be attached in a similar manner. Of course, the receiving ends 2*a* and 3*a* of segments 2 and 3 can be milled or cut according to the shape of the bearing.

Alternatively, the drill stem stabilizer 1, including the bearing 4 and the support member 5, could be manufactured as a single piece, with similar characteristics as discussed above. Similar to the bearing 4 described above, the opening in the single piece stabilizer is formed to accommodate the drill stem 10 therein.

The preferred initial operation of placing the preferred embodiment of the drill stem stabilizer 1 on a drilling apparatus will now be described. Initially, the cutting tool at the end of the drill stem 10 is lowered into the coke drum 20 (fitted with a stem guide). The stem guide is closed around the drill stem 10, thereby ensuring that the stem 10 is properly oriented for attachment of the drill stem stabilizer 1. Split ring pieces 4*a* and 4*b*, with the segments 2 and 3 respectively attached, are placed around the drill stem 10 and secured to one another, as discussed above. The split ring pieces 4*a* and 4*b* are then fastened together to form the bearing 4. As noted above, if an uncut bearing 4 is used, the drill stem 10 would be threaded through the bearing 4, prior to placement of the cutting tool onto the drill stem 10.

The bar segments 2 and 3 extend radially in opposite directions from the bearing 4 as the bearing 4 encases the drill stem 10. Thereafter, each attaching end 2*b* and 3*b* of the drill stem stabilizer 1 is secured preferably to the guide-rail 14*a* or 14*b* to properly position the bearing 4 with respect to the top drum opening.

If attached to the guide-rails 14*a* and 14*b*, the stabilizer 1 can be positioned and attached anywhere between the bottom end E of the guide rails 14*a* and 14*b* (i.e., the end closest to the drum 20) of the guide rails 14*a* and 14*b* and the mechanical stops 13*a* and 13*b*, provided that the motion of the drill assembly is not impeded. In order to facilitate attachment and to maximize drill-stem stability, the stabilizer 1 is preferably positioned at the bottom end E of the guide rails 14*a* and 14*b* (see FIG. 2).

Figure 6:
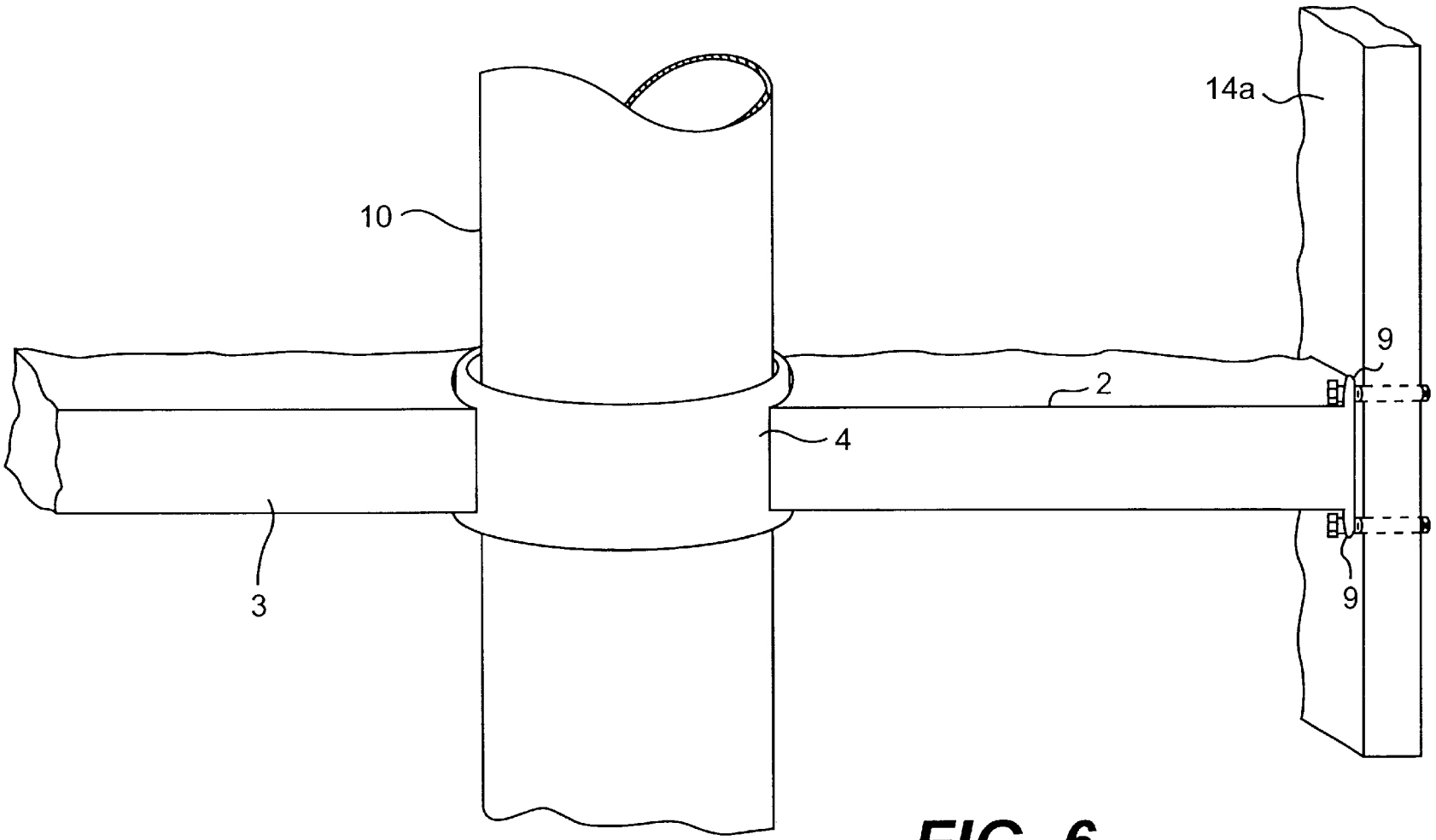
FIG. 6 is a partial side view of the drill stem stabilizer shown in FIG. 2.

The ends 2*b* and 3*b* of the drill stem stabilizer 1 are secured by bolting, welding, or other suitable method. If bolts are used, a fastening flange 9 (see FIG. 6) can be provided on each attaching end 2*b* and 3*b* of segments 2 and 3 to accommodate and receive the securing bolts. If the stabilizer is secured to the guide rails 14*a* and 14*b*, the attaching ends 2*b* and 3*b* can be adapted to attach to any type of guide rail. For example, a clamp, receiving flange, or groove can be employed at each attaching end 2*b* and 3*b* to accommodate differently shaped guide rail structures.

Alternatively, the supporting member 5 can be attached to the superstructure 17, as long as the bearing 4 is maintained in a proper position. Attachment to the superstructure 17 is achieved in a similar manner as is discussed above with respect to attaching the support member 5 to the guide rails 14*a* and 14*b*.

Once attached, the drill stem stabilizer 1 need not be removed between successive decoking operations. Rather, the drill stem 10 can be retracted to the point where the cutting tool approaches or abuts the stabilizer. Thereafter, the stabilizer 1 helps to hold the cutting tool and the drill stem 10 steady until needed for a subsequent decoking operation.

Figure 7:
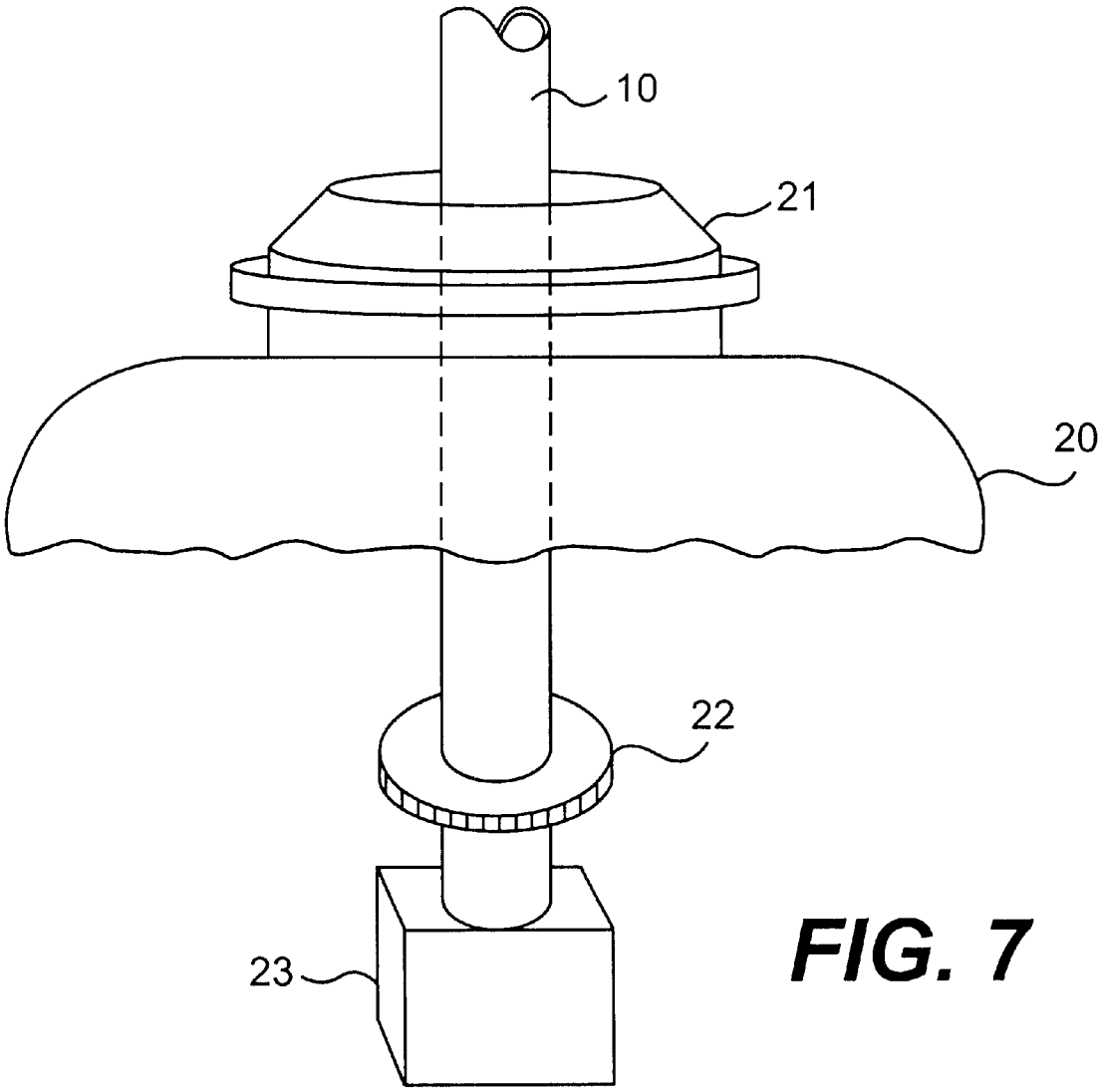
FIG. 7 is a partial side schematic view of the coke drum and a stem guide, with a drill stem and a collar attachment according to an aspect of the present invention, positioned within the coke drum.
Figure 8:
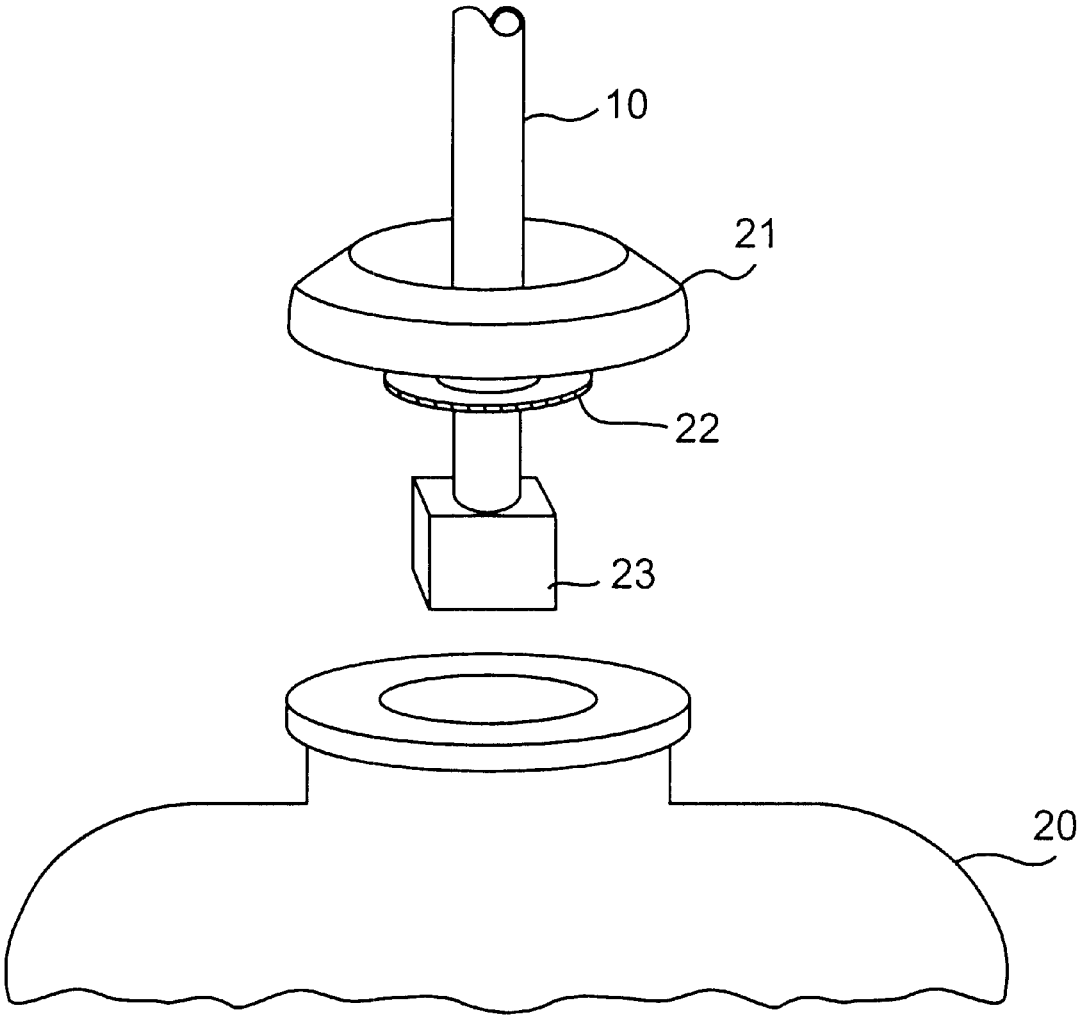
FIG. 8 is a diagram showing the drill stem of FIG. 7 being removed from the coke drum, along with the drill stem guide.

Another major advantage of the drill stem stabilizer 1 of the present invention is illustrated in FIGS. 7 and 8. A collar 22 can be attached around the drill stem 10 above the cutting tool 23 at a location that in operation will be below the stem guide 21. The collar 22 can be a plate, pipe segment or the like with an opening through which the drill stem 10 can be threaded, or a split pipe segment or the like that is clamped around the drill stem 10. Once in position, the collar 22 can then be welded or otherwise attached to the drill stem 10. Using this collar 22 feature, the guide 21 can be lifted up by the drill stem 10 from its position on the coke drum 20 when the cutting tool is not in use. Preferably, the size of the collar 22 will be chosen so as to fit through the guide 21 when open, but not when the guide 21 is closed.

During the decoking process, the guide 21 is in place on the drum 20, the drill stem 10 and collar 22 are positioned within the drum 20, and the guide 21 is closed around the drill stem 10. When the decoking process is finished, the guide 21 is not opened, but is unlocked or otherwise disconnected from the drum 20. The guide 21 remains closed as the drill stem 10 is retracted vertically up through the guide 21. Once the collar 22 contacts the underside (i.e., the side facing the inside of the drum 20) of the guide 21, the guide 21 is lifted vertically along with the drill stem 10 (see FIG. 8).

Lifting the guide 21 up along with the drill stem 10 provides convenient manipulation and out-of-the-way storage for the guide 21 between decoking operations. Lifting up the guide 21 as previously described also reduces the number of operators required to remove the guide 21 from the drum 20. After unlocking the guide 21 from the drum 20, only the operator of the crosshead winch (not shown), which raises the drill stem 10, is needed to remove the guide 21 along with the drill stem 10.

Due to the increased weight of the guide 21, however, the pendulum effect on the drill stem 10 is magnified in conventional devices. In other words, the problems created by the tendency of the drill stem 10 to swing back and forth are exaggerated by the added weight of the stem guide 21. Therefore, an operator trying to guide and control the swinging drill stem 10 and guide 21 would be placed at even greater risk. To the contrary, the drill stem 10 (and guide 21) can be stabilized and safely guided into and out of the drum 20 by the drill stem stabilizer 1 according to my invention. The stabilizer 1 inhibits the pendulum motion by restricting the lateral movement of the drill stem 10 as the stem 10 is moved vertically above the coke drum 20. Hence, the guidance and stability provided by the drill stem stabilizer 1 to the drill stem 10 also facilitates its manipulation even under the increased weight of the drill guide 21.

While this invention has been described with respect to what is at present considered to be the preferred embodiments, the invention should not be limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

I claim:

1. A stabilizer in a decoking apparatus that is for use with a coking drum having a top opening, the decoking apparatus including a drill stem, a crosshead from which the drill stem depends, and a pair of substantially vertical guide rails on which the crosshead rides, said stabilizer comprising:

a bearing encasing the drill stem so as to limit lateral movement of the drill stem; and a support member extending laterally from said bearing and attached to each of the pair of the guide rails, said support member maintaining said bearing in a position to align the drill stem with the top opening of the drum.

2. The stabilizer according to claim 1, wherein said support member comprises two beam segments each attached to said bearing.

3. The stabilizer according to claim 1, wherein said bearing comprises two longitudinally-split half-cylindrical rings that are adapted to be attached to one another to form a cylindrical ring surrounding the drill stem.

4. The stabilizer according to claim 3, wherein each of said half-cylindrical rings includes a pair of longitudinal faces that mate with corresponding faces of the other of said half-cylindrical rings, and a complementary pair of flanges by which said half-cylindrical rings are secured together, each of said flanges extending from near one of said longitudinal faces.

5. The stabilizer according to claim 4, further comprising at least one spacer disposed between the respective flanges of said two half-cylindrical rings.

6. The stabilizer according to claim 1, further comprising a bushing lining an inner surface of said bearing.

7. The stabilizer according to claim 6, wherein said bushing is made from TEFLON®.

8. The stabilizer according to claim 1, wherein said support member is attached to a lower end of each of the pair of guide rails.

9. The stabilizer according to claim 1, wherein said stabilizer is attached to the guide rails by bolts.

10. The stabilizer according to claim 1, wherein the guide rails are comprised of a pair of I-beams defining complementary channels in which the crosshead rides, and said support member comprises a pair of I-beam segments, said I-beam segments each having an attaching end and a receiving end, the attaching end nesting within and being secured to a respective one of the channels, and the receiving end attaching to said bearing.

11. A coke drilling apparatus for use with a coking drum having a top opening, said coke drilling apparatus comprising:

a drill stem;

a crosshead from which said drill stem depends;

a pair of substantially vertical guide rails on which said crosshead rides; and a drill stem stabilizer attached to each of said pair of guide rails, said stabilizer defining an opening through which said drill stem extends, said opening being positioned so as to align said drill stem with the top opening of the drum.

12. The coke drilling apparatus of claim 11, wherein said stabilizer comprises a bearing through which said opening extends, and a support member extending laterally from said bearing to attach to said guide rails.

13. The coke drilling apparatus of claim 11, wherein said support member comprises two beam segments each attached to said bearing.

14. The coke drilling apparatus of claim 13, wherein said bearing comprises two longitudinally-split half-cylindrical rings that are adapted to be attached to one another so as to form a cylindrical ring surrounding the drill stem.

15. The coke drilling apparatus of claim 11, wherein said coke drilling apparatus is usable with a drill stem guide attachable to the top drum opening, the stem guide having an opening through which said drill stem extends, and said coke drilling apparatus comprises a collar fixed to said drill stem at a location that is below the stem guide when the coke drilling apparatus is in operation, said collar being sized so as not to pass through the opening of the stem guide such that the stem guide can be vertically raised or lowered along with said drill stem.

16. A stabilizer used in a decoking apparatus that is for use with a coke drum, the apparatus including a drill stem and a support structure supporting a crosshead on which the drill stem is supported for vertical movement above and within the coke drum, said stabilizer comprising: a bearing encasing the drill stem so as to limit lateral movement of the drill stem; and a support member extending laterally from said bearing and attached to the support structure, said support member maintaining said bearing in a position to guide the drill stem into and out of the coke drum.

17. The stabilizer according to claim 16, wherein said support member comprises two beam segments each attached to said bearing.

18. The stabilizer according to claim 16, wherein said bearing comprises two longitudinally-split half-cylindrical rings which are adapted to be attached to one another to form a cylindrical ring surrounding the drill stem.

19. The stabilizer according to claim 18, wherein each of said half-cylindrical rings includes a pair of longitudinal faces that mate with corresponding faces of the other of said half-cylindrical rings, and a complementary pair of flanges by which said half-cylindrical rings are secured together, each of said flanges extending from near one of said longitudinal faces.

20. The stabilizer according to claim 19, further comprising at least one spacer disposed between the respective flanges of said two half-cylindrical rings.

21. The stabilizer according to claim 16, further comprising a bushing lining an inner surface of said bearing.

22. The stabilizer according to claim 21, wherein said bushing is made from TEFLON®.

23. The stabilizer according to claim 16, wherein the decoking apparatus further includes a crosshead from which the drill stem depends, and a pair of substantially vertical guide rails on which the crosshead rides, and said support member attaches to each of the pair of guide rails.

24. The stabilizer according to claim 23, wherein said support member attaches to the guide rails by bolts.

25. The stabilizer according to claim 23, wherein the guide rails are comprised of a pair of I-beams defining complementary channels in which the crosshead rides, and said support member comprises a pair of I-beam segments, said I-beam segments each having an attaching end and a receiving end, the attaching end nesting within and secured to a respective one of the channels, and the receiving end attaching to said bearing.

26. The stabilizing apparatus according to claim 25, wherein the attaching end of each I-beam support member includes a flange, and each flange attaches to a respective one of the guide rails.

27. A stabilizer in a decoking apparatus that is for use with a coking drum having a top opening, the decoking apparatus including a drill stem, a crosshead from which the drill stem depends, and a pair of substantially vertical I-beam guide rails defining channels in which the crosshead rides, said stabilizer comprising:

a bearing comprising a complementary pair of half-cylindrical rings, each of said half-cylindrical rings including (i) a pair of longitudinal faces, which mate with corresponding faces of the other of said half-cylindrical rings, and (ii) a flange by which said two half-cylindrical rings are attached to one another to form a cylindrical ring, said flanges extending from near each of said pair of longitudinal faces, said cylindrical ring encasing the drill stem so as to limit lateral movement of the drill stem; and a support member comprising two I-beam segments extending laterally from said bearing, each I-beam segment having an attaching end and a receiving end, the attaching end nesting within and attaching to the channel of a respective one of the pair of the I-beam guide rails, the receiving end attaching to said bearing, and said support member maintaining said bearing in a position to align the drill stem with the top opening of the drum.

* * * * *